United States Patent [19]

Harris

[11] 4,169,294

[45] Oct. 2, 1979

[54] PLATFORM BED FRAME

[76] Inventor: George M. Harris, 505 N. Lake Shore Dr., Chicago, Ill. 60611

[21] Appl. No.: 883,928

[22] Filed: Mar. 6, 1978

[51] Int. Cl.[2] ..... A47C 19/04; F16B 5/07

[52] U.S. Cl. ..... 5/200 R; 5/201; 5/207

[58] Field of Search ..... 312/253, 254; 5/184, 5/191, 200 R-202, 207; 297/440; 108/51; 52/753 D, 589, 285

[56] References Cited

U.S. PATENT DOCUMENTS

| | | | |
|---|---|---|---|
| 3,501,786 | 3/1970 | Hurwitz | 5/207 |
| 3,754,289 | 8/1973 | Lankin | 5/200 R |
| 3,824,638 | 7/1974 | Bogar, Jr. | 5/202 |
| 3,869,738 | 3/1975 | Lawrence | 5/200 R |
| 3,949,534 | 4/1976 | Croy et al. | 297/440 |

*Primary Examiner*—Casmir A. Nunberg

[57] ABSTRACT

A platform bed frame for a platform bed is provided which is capable of supporting a conventional mattress and box spring combination, or a mattress alone. The platform bed frame includes side plates and end plates which are connected together by tapered pins on the side plates and end plates which coact to produce a rigid structure.

12 Claims, 3 Drawing Figures

PLATFORM BED FRAME

BACKGROUND OF THE INVENTION

This invention relates to platform bed frames for platform beds, and specifically to a connecting means for securing the sides plates and end plates of a platform for a platform bed together.

For a number of years, platform beds, which consist of a mattress sitting on a platform, have been widely used in Europe but have not been widely accepted in the more affluent United States. A major reason for the popularity of these beds in Europe is that living quarters generally have much less space than is the case in the United States, and platform beds are more space-efficient than the conventional Hollywood-type beds which have almost totally dominated the domestic market. Recently, there has been an upsurge of interest in this country in platform beds, and this new founded popularity is generally attributed to apartment dwellers who must make more efficient use of space than home owners. In addition, platform beds blend well with modern furniture, and especially well with modular furniture that is popular in many apartment dwellings because it maximizes the use of floor space. Also, platform beds have a number of other advantages over the conventional Hollywood beds. For example, the exposed legs of conventional Hollywood bed frames are a major cause of many household accidents, notably stubbed toes, and the like. Platform beds do not have exposed legs, and thus are not as likely to cause such accidents. And, because a platform bed does not have legs and sit on the floor, it totally encloses the floor space upon which it rests, and thus obviates the need to dust or vacuum underneath the bed.

The platform bed frame or platform of a platform bed, generally includes two side plates or panels, which are joined to transversely disposed end plates by conventional coupling members, such as screws and bolts, and the like. One problem with joining platform bed frames in this manner is that in some cases the screws and bolts are visible on the outer portion of the platform and detract from its appearance. Another problem is that screws and bolts are easily lost during shipment. Thus, it is desirable to fabricate side plates and end plates which have coupling members in a form which is not easily lost, and which are preferably secured on the side plates and end plates so that they may be shipped without any loose parts and in a condition whereby a consumer can merely slide the side plates and end plates together in a matter of minutes to form the platform bed.

Another problem with most prior art platform bed frames for platform beds, is that they have been usually designed to support only a mattress, and not the conventional box spring and mattress combination which is used on a Hollywood bed frame. When a conventional mattress is used on a platform bed frame, it is not as comfortable as the mattress box spring combination used on a Hollywood bed frame, because the box spring provides an extra amount of cushioning that increases the comfort of the conventional mattress. To overcome this problem, specially made mattresses have been designed for use on platform bed frames. However, these specially designed mattresses are not as readily available as conventional mattresses, and are generally more expensive. Moreover, potential users of platform beds may desire to use a mattress which they already own, and may be unwilling to spend extra money to purchase a specially-made mattress. Consequently, price and comfort considerations may deter some potential purchasers from buying platform beds. Thus, the availability of a platform bed frame which could support the conventional box spring and mattress combination, could alleviate this problem, and provide more people with a viable option of using platform beds with their consequent safety and utility advantages.

SUMMARY OF THE INVENTION

In accordance with the present invention, a platform bed frame for a platform bed is provided which is capable for supporting a conventional mattress and box spring combination, or a conventional mattress alone. Preferably the side plates and end plates are metal and are provided with connecting means which may be interlocked without using screws and bolts.

More specifically, the platform bed frame comprises a pair of spaced parallel side plates having substantially identical dimensions. Each side plate includes a wall portion, a support portion, and a foot portion. The wall portion defines an upper edge and a lower edge and is disposed in relation to the floor to provide upright support for a mattress and/or box spring. The support portion of each side plate is integral with the upper edge of the wall portion and provides horizontal support for the frame portion of a box spring so that the box spring may be disposed directly on the platform bed frame, or for conventional slats which may be disposed crosswise between the side plates to support either a conventional mattress or a mattress and box spring. The foot portion is integral with the lower edge of the wall portion and serves to confront the floor or surface upon which the platform is situated. The end plates are longitudinally spaced with respect to the side plates and extend perpendicularly between them so that the end plates and side plates define a substantially rectangular platform bed frame. Each end plate has substantially the same dimensions and includes an intermediate portion, an upper arm portion, and a lower leg portion. The intermediate portion defines an upper edge and a lower edge and is disposed in relation to the floor to provide upright support for the mattress and/or box spring. An upper arm portion is integral with the upper edge of the intermediate portion and provides support for a portion of the mattress and/or box spring. A lower leg portion extends from the lower edge of the intermediate portion and confronts the floor upon which the platform is situated.

The end portions of the side plates and end plates are positioned in overlapping relationship, and connecting means are provided on the overlapped portions of the side plates and end plates for detachably securing each of the end plates to the side plates to form a generally rectangular platform are also provided.

In one preferred embodiment, the ends of the arm portions of the end plates extend outwardly beyond the ends of the intermediate portion thereof, and are positioned in surface to surface contact with the ends of the support portion of the side plates, while the ends of the leg portions of the end plates are positioned in surface to surface contact with the ends of the foot portions of the side plates. The connecting means is provided by coacting male and female members on the overlapping portions of the frame, which enable the side plates and end plates to be readily assembled without the use of extraneous fasteners or tools. The male members preferably take the form of tapered pins that are permanently secured to the side and end plates, while the female members comprise apertures for receiving such pins. In a most preferred embodiment a pair of downwardly extending pins are provided on the outwardly extending ends of the arm portions of the end plates and an upwardly extending pin is provided on the ends of the foot portions of the side plates. When such pins are engaged within corresponding apertures in the leg portions of the end plates and the support portions of the side plates, an extremely rigid structure is produced.

DETAILED DESCRIPTION OF THE DRAWINGS

DETAILED DESCRIPTION

Figures 1, 2, 3:
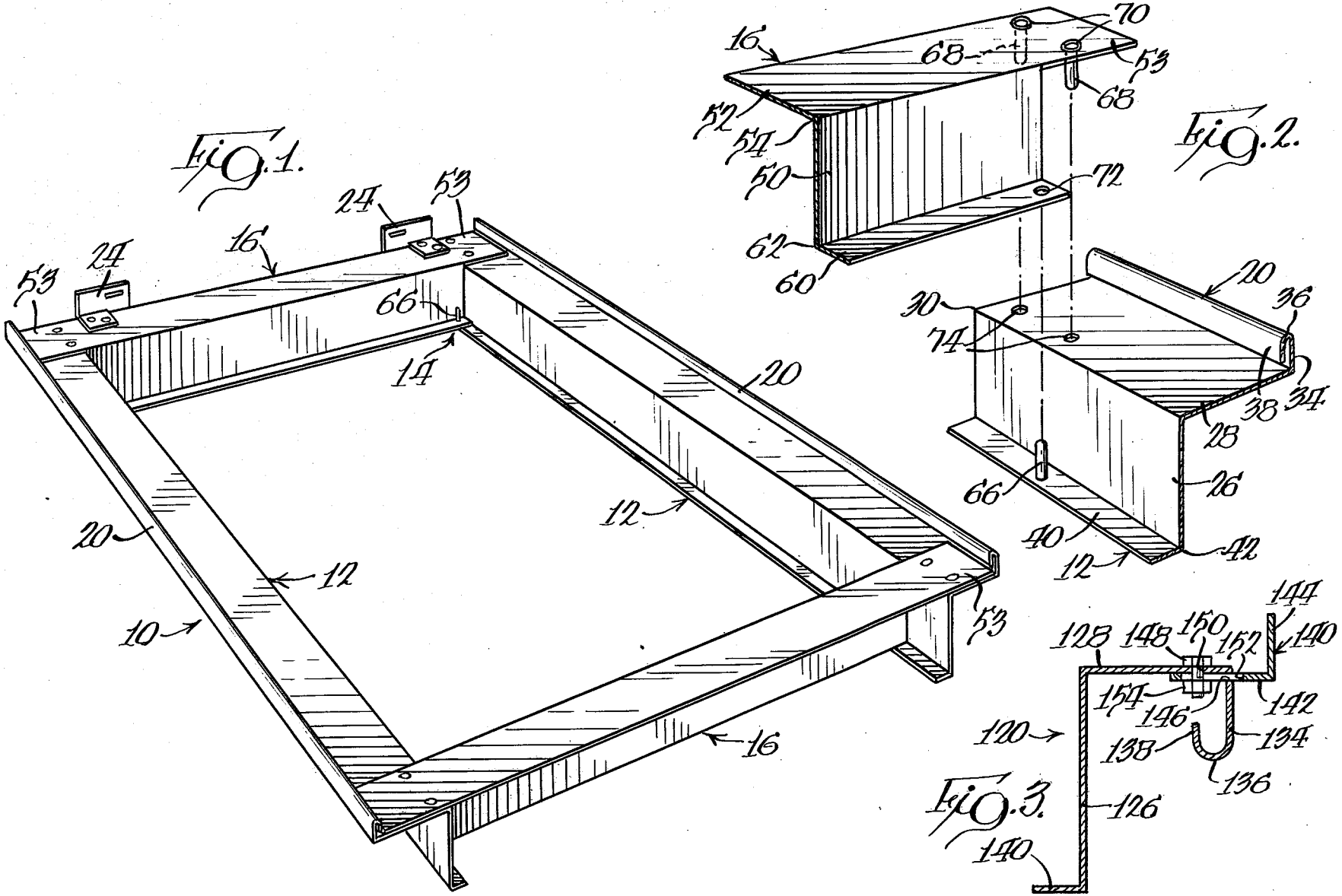
FIG. 1 is a perspective view of a platform bed frame in accordance with the present invention.
FIG. 2 is an enlarged fragmentary perspective view showing the connecting means of the present invention.
FIG. 3 is a cross-sectional view through a modified side plate of the platform bed frame.

While this invention is susceptible of embodiment in many different forms, there is shown in the drawings and herein will be described in detail a preferred embodiment of the invention and a modification thereof, with the understanding that the present disclosure is to be considered as an exemplification of the principals of the invention and is not intended to limit the invention to the embodiments illustrated. The scope of the invention will be pointed out in the appended claims.

Referring now to the drawings, FIG. 1 shows a platform bed frame which, for purposes of convenience, is hereinafter referred to as a platform. The platform 10 includes side plates 12 which are in spaced relationship with one another and are interconnected by connecting means 14 to end plates 16 which extend perpendicularly between the side plates to form a generally rectangular platform. A mattress is suitably disposed on the platform 10 in use, and is prevented from moving transversely with respect to the side plates by means of flanges 20 which extend upwardly from the side plates 12 on both sides of the platform. The transverse distance between the flanges 20 is slightly greater than the width of the mattress which is to be disposed on the platform 10 so that the mattress may be securely placed on the platform. The platform may suitably be provided with a headboard which is secured to the platform by headboard brackets 24.

The side plates 12 of the platform have a unique configuration which enables the platform bed base to support not only a mattress, but also a box spring and mattress combination as is ordinarily used on a Hollywood bed frame. Side plates 12 include a wall portion 26 which is disposed in relation to the floor to provide upright support for the mattress and/or box spring. Preferably wall portion 26 is substantially planar and has a generally rectangular shape so that the mattress may be supported at a uniform height from the floor. Support portion 28 extends from the top edge 30 of wall portion 26 in a direction which is generally transverse of wall portion 26 and generally parallel to the floor. A flange member 20 is integral with the outer edge of support member 28. Flange member 20 includes a generally planar portion 34 which extends upwardly from the support member 28 to an arcuate portion 36 which extends inwardly of planar portion 34 to a terminal portion 38 which extends downwardly from the arcuate portion 36.

A foot portion 40 is integral with the lower edge 42 of wall portion 26, and serves to confront the surface upon which the platform bed base 10 is situated. Foot portion 40 extends generally inwardly of the wall portion 26 so that there are no outward protrusions from the side plate 12. Foot portion 40 is substantially planar for engagement with the floor and is integral with the lower edge 42 of wall portion 26.

Two identical end plates 16 are disposed between the side plates 12 in spaced relationship with respect to the length of the side plates, and are oriented generally transversely of the side plates to form a generally rectangular platform. Each end plate 16 has substantially the same dimensions and each end plate 16 includes an intermediate portion 50 which is preferably of the same height as wall portion 26 of each side plate 12. Intermediate portion 50 is disposed in relation to the floor to provide upward support for the mattress and/or box spring, and preferably is generally planar and has a rectangular shape. An upper arm portion 52 extends outwardly from upper edge 54 of intermediate portion 50, and is substantially planar and transverse to the intermediate portion 50. A lower leg portion 60 is integral with the lower edge 62 of the intermediate portion 50. Lower leg portion 60 is generally planar and extends inwardly from intermediate portion 50 and confronts the surface of the floor. Leg portion 60 is coterminous with intermediate portion 50, while arm portion 52 includes ends 53 which extend beyond the ends of intermediate portion 50 and leg portion 60.

When the platform is assembled, the ends of intermediate portion 50 are disposed adjacent wall portions 26 inwardly of the ends of the wall portion, and the arm ends 53 and ends of legs 60 are positioned in overlapping surface to surface contact with the ends of support portions 28 and foot portions 40, respectively.

When the end plates 16 are joined to the side plates 12 a substantially rectangular platform is formed, and the upper surfaces of support portions 28 of the side plates 12 are generally coplanar with the upper surfaces of planar upper arm portions 52 of end plates 16. These generally coplanar surfaces coact to provide a peripheral support for bedding such as a mattress and box spring combination.

If a mattress and box spring combination is used on the platform, the box spring may be placed directly on the platform with its frame being supported on the generally coplanar surfaces defined by support portions 28 of side rails 12 and also on planar upper arm portions 52. Thus, the platform of the present invention may support an ordinary box spring/mattress combination which is commonly used with Hollywood bed frames. This provides the user with the same degree of sleeping comfort when using a platform bed in accordance with the present invention as is commonly available using Hollywood bed frames. Also, when the box spring is disposed on the platform, terminal portion 38 ideally abuts the mattress or box spring disposed on the support member 28 and prevents it from moving transversely with respect to the side plate 12 of the platform. If an ordinary mattress is used without a box spring, it may be supported on a flat board or alternatively on slats, or on a flat board placed over the slats.

The connecting means includes interengaging male and female members on the overlapping ends of the side and end plates which may be readily telescopically, or slidably, engaged without the use of special tools or extraneous fasteners. The male members include a pin 66 extending upwardly from foot portion 40 adjacent each end thereof and a pair of pins 68 extending downwardly from each end 53 of arm portion 52. Pins 66 and 68 are permanently attached to the side and end plates, respectively, and to this end, the pins may have an external shoulder which abuts the upper surface of foot portions 40 and the lower surface of arm end portions 53 (as viewed in FIG. 2), while the end of the pins on the opposite side of foot portions 40 and arm end portions is hollow and headed over as shown at 70. The female members are defined by aperture 72 in leg portion 60 and a pair of apertures 74 in support portion 28.

Pins 68 and apertures 74 are disposed on a line that is parallel to wall portion 26 and closely adjacent thereto, and pins 66 are spaced inwardly of the innermost aperture 74. With this arrangement, pins 66 are positioned interiorly of the platform, while pins 68 are shielded by the overhang of support portions 28.

The free ends of pins 66 and 68 are tapered to facilitate entry into apertures 72 and 74 and to provide for a slight wedging action as the platform is assembled. The tapering of the pins is of particular importance in the event of slight misalignment between the pins and apertures. With a connection means as described above, a platform is created which has surprising and unusual rigidity.

While flange means 34, 36 and 38 have been shown as being formed integrally with the side plates, this is not necessary, or critical, to the present invention. Such flange means may be eliminated entirely, if for example a heavy water bed mattress is used. And, in some instances it may be desirable to provide a flange means that is adjustable relative to the platform, so as to accommodate bedding of varying width. Such a construction is shown in FIG. 3, wherein reference numbers in the 100 series are used to designate those elements which correspond to the elements of the embodiment of FIGS. 1 and 2.

Side plate 120 includes a flange member, but instead of extending upwardly, it includes a downwardly extending planar portion 134, an inwardly curved arcuate portion 136, and an upwardly extending portion 138. Flange means 140 is adjustably mounted on side plate 120, and includes an L-shaped bracket having a horizontal leg 142, that extends through a slot 146 in planar portion 142, and a vertical leg 144, that extends above support portion 128 to confine the side edge of the bedding that is supported thereon. A bolt 148 extends through a clearance opening 150 in support portion 128 and through an elongate slot 152 in horizontal leg 142. A nut 154 is threadably received on bolt 148, and it will readily be appreciated that flange means 140 may be adjusted relative to the platform by merely loosening nut 154 and then moving the flange means in or out, as the case may be, so that the upwardly extending leg 144 is positioned in close proximity to the side edge of the bedding on the platform.

I claim:

1. A platform bed frame for supporting mattress means in spaced relationship to a floor comprising: a pair of spaced parallel side plates, each side plate having substantially the same dimensions and including a wall portion having an upper edge and a lower edge and disposed in relation to the floor to provide upright support for said mattress means, a support portion for providing support for a peripheral part of said mattress means, the support portion integral with the upper edge of the wall portion and disposed generally transversely of and extending outwardly of the wall portion to provide support for said mattress means, a flange member extending generally upwardly of and integral with said support portion for preventing lateral movement of said mattress means with respect to said platform, and a foot portion integral with the lower edge of said wall portion for confronting the surface upon which the platform is situated, said foot portion extending generally inwardly of said wall portion and including a substantially planar portion integral with said wall portion and extending inwardly of said wall portion, a pair of longitudinally spaced end plates extending substantially transversely between said side plates, each end plate having substantially the same dimensions and including an intermediate portion having an upper edge and a lower edge and two ends and disposed in relation to the floor to provide upright support for said mattress means, an upper arm portion for supporting a peripheral portion of said mattress means, the upper arm portion integral with the upper edge of the intermediate portion, and a lower leg portion integral with the lower edge of the intermediate portion for confronting the surface upon which said platform is situated; the ends of said side plates and end plates being positioned in overlapping relationship with one another; and means for detachably securing each of said end plates to each of said side plates to form a generally rectangular platform and comprising opposing male members and a female member complementary to each of said male members on the overlapping ends of said side plates and said end plates, said male and female members being engageable with one another when the ends of said side plates and said end plates are positioned in overlapping relationship with one another.

2. A platform bed frame as set forth in claim 1 wherein the ends of each upper arm portion extend outwardly from the intermediate portion and are positioned in surface to surface contact with the end of a support portion.

3. A platform bed frame as set forth in claim 2 wherein said female member includes a pair of spaced apertures in each end of each support portion and said male member includes a pair of pins extending downwardly from each end of each arm portion, each pin being received in one of said apertures.

4. A platform bed frame as set forth in claim 1 wherein the ends of said leg portions are positioned in overlapping surface to surface contact with the ends of said foot portions.

5. A platform bed frame as set forth in claim 4 wherein said female member includes an aperture in each end of each leg portion and said male members includes a pin extending upwardly from each end of said foot portions each pin being received in one of said apertures.

6. A platform bed from for supporting mattress means in spaced relationship to a floor, comprising: a pair of spaced parallel side plates, each side plate having substantially the same dimensions and including a wall portion having an upper edge and a lower edge and disposed generally vertically in relation to the floor, an upper horizontal member integral with the upper edge of the wall portion, and a generally horizontal foot portion integral with the lower edge of said wall portion for confronting the surface upon which the platform is situated, said foot portion extending generally inwardly of said wall portion and including a substantially planar portion integral with said wall portion; a pair of longitudinally spaced end plates extending substantially transversely between said side plates, each end plate having substantially the same dimensions and including an intermediate portion having an upper edge and a lower edge and two ends and disposed generally vertically in relation to the floor, a generally horizontal upper arm portion integral with the upper edge of the intermediate portion, and a generally horizontal lower leg portion integral with the lower edge of the intermediate portion for confronting the surface upon which said platform is situated; and means for detachably securing each of said end plates to each of said side plates to form a generally rectangular platform including a pair of opposed pin means and a complementary aperture in said side plates and said end plates for each said pin means; said pin means being engageable within each of said apertures when the ends of said side plates and said end plates are positioned adjacent one another.

7. A platform bed frame as set forth in claim 6 wherein the free end of each pin means is tapered.

8. A platform bed frame as set forth in claim 6 wherein said wall portions are perpendicular to said intermediate portions, and the apertures in said support portions are disposed in a line generally parallel with said wall portions.

9. A platform bed frame as set forth in claim 6 including flange means extending upwardly from said upper horizontal members for preventing lateral movement of said mattress means relative to said platform.

10. A platform bed frame as set forth in claim 9 wherein said flange means is integral with said support portions.

11. A platform bed frame as set forth in claim 6 wherein at least one pin means is permanently attached to each end of each side plate and at least one pin means is permanently attached to each end of each end plate.

12. A platform bed frame as set forth in claim 6 wherein said foot portion and said leg portion are positionable in overlapping relationship with one another, one of said foot portion and leg portion being provided with said pin means and the other of said foot portion and leg portion being provided with one of said apertures, said pin means being engageable within said aperture when said foot portion and leg portion are overlapping.

* * * * *

UNITED STATES PATENT AND TRADEMARK OFFICE

CERTIFICATE OF CORRECTION

PATENT NO. : 4,169,294

DATED : October 2, 1979

INVENTOR(S) : George M. Harris

It is certified that error appears in the above-identified patent and that said Letters Patent are hereby corrected as shown below:

Column 5, line 45, insert "terminal" before "portion" (second occurrence).

Column 6, line 59, "from" should be --frame--;

Column 8, lines 9-10, in claim 10, "support portions" should be --upper horizontal members--.

Signed and Sealed this

*Eighteenth* Day of *December 1979*

[SEAL]

*Attest:*

SIDNEY A. DIAMOND

*Attesting Officer*

*Commissioner of Patents and Trademarks*